US006612650B1

(12) United States Patent
Ambrosio et al.

(10) Patent No.: US 6,612,650 B1
(45) Date of Patent: Sep. 2, 2003

(54) ARMCHAIR WITH POWER-DRIVEN FOOTREST, BACK, AND BASE SEAT

(75) Inventors: Clara Ambrosio, Inzago (IT); Carlo Bossoni, Milan (IT); Marco Parrini, Milan (IT)

(73) Assignee: Compact S.r.l. (IT)

( * ) Notice: Subject to any disclaimer, the term of this patent is extended or adjusted under 35 U.S.C. 154(b) by 0 days.

(21) Appl. No.: 09/554,854

(22) PCT Filed: Nov. 13, 1998

(86) PCT No.: PCT/EP98/07339

§ 371 (c)(1),
(2), (4) Date: May 19, 2000

(87) PCT Pub. No.: WO99/26517

PCT Pub. Date: Jun. 3, 1999

(30) Foreign Application Priority Data

Nov. 21, 1997 (IT) ..... MI97A2590

(51) Int. Cl.[7] ..... A47C 1/035

(52) U.S. Cl. ..... 297/330; 297/68; 297/423.26; 297/423.3

(58) Field of Search ..... 297/330, 75, 68, 297/71, 423.26, 423.3

(56) References Cited

U.S. PATENT DOCUMENTS 3,934,928 A * 1/1976 Johnson ..... 297/330
4,017,118 A * 4/1977 Cawley ..... 297/75 X
4,691,964 A * 9/1987 Morgan ..... 297/330
4,937,900 A * 7/1990 Bridges ..... 297/330 X

* cited by examiner

*Primary Examiner*—Anthony D. Barfield
(74) *Attorney, Agent, or Firm*—Shlesinger, Fitzsimmons & Shlesinger

(57) ABSTRACT

An armchair (10) comprises a support frame (11, 12) to which a base seat (14), a back (16) and a footrest (26) are fastened, which elements are movable between a first and a second positions through power-driven movement means (21). The power-driven means (21) is suspended from said base seat (14) and movable therewith. Advantageously, the power-driven means is formed as a single power unit (21), having two independent driving shafts (22, 23). Still advantageously, the base seat (14) is pivotally mounted, at the front, to the support frame according to a first transverse axis (15); pivotally mounted to the rear of the base seat is the back (16) according to a second transverse axis (17) for rotation of the back itself; the back (16) has extensions (18) extending downwardly past said second axis (17) and having ends constrained to slide longitudinally of the armchair, so that upon rotation of the back about the second axis (17), the base seat rotates in the same way about the first axis (15).

9 Claims, 2 Drawing Sheets

ARMCHAIR WITH POWER-DRIVEN FOOTREST, BACK, AND BASE SEAT

FIELD OF THE INVENTION

The present invention relates to an innovatory armchair structure of the type provided with a footrest and a back that are movable by electric motors.

BACKGROUND OF THE INVENTION

Objects and Summary of the Invention

Further motor-driven transmission mechanisms are disclosed by U.S. Pat. No. 3,934,929, wherein a worm screw actuator is connected on one ends the seat of the chair and on the other to the backrest, and by DE-U-8904979, wherein the movement of chair portions is obtained thanks to a motor unit extending between a fixed frame and the backrest.

Well known in the art are armchairs having a footrest and a back adapted to be drivingly inclined by means of electric motors. For strength and economy purposes the so-called "dual motors" are very used; they are made up of a monolithic unit of a generally rectangular shape having two motor reducers inside it, the rotation shafts of which project close to the two ends of the unit.

The dual motor is mounted on a fixed frame of the armchair for extending longitudinally thereof, with a rotation shaft which is close to the back and the other rotation shaft which is close to the footrest. Crank mechanisms connect each rotation shaft to the respective element (back or footrest) to be moved.

Usually, the rear shaft controls movement of the back, whereas the front shaft simultaneously controls movement of the footrest and the base seat, in terms of lifting the base seat (pivotally mounted, at the back, to the fixed frame) at the front, as the footrest itself moves upwardly.

For movement transmission, kinematic connecting rod-crank mechanisms connect the rear shaft to the back and the front shaft to the footrest and the base seat.

This structure is rather complicated, relatively expensive and bulky.

In addition, the inclination movement of the base seat should have to be used for maintaining a given angle between the bust and the pelvis when the back is greatly inclined. However, due to the fact that the base seat movement is only connected to the footrest movement, this effect cannot be reached if the footrest is left at its lowered position or at all events it is not completely raised.

But, when the footrest is even only partly lowered there is the maximum requirement of keeping an angle between the seat base and the back for avoiding too much stress at the lumbar region.

In the opposite case too, if the footrest is wished to be raised leaving the back at its completely lifted position, too much stress may be caused at the lumbar region. In fact, since the base seat movement is connected to the footrest movement, by raising the footrest, the angle between the base seat and the back is simultaneously reduced. If the back is completely raised, this angle may become too small for a comfortable position.

A further undesirable effect present in the above-mentioned known art is that of having a distance between the front shaft and the footrest which increases on increasing of the base seat inclination, because the footrest is hinged on the front edge of the base seat and moves therewith, whereas the motor is fixed to the ground.

As a result, the driving shaft must have a relatively high rotation angle for completely raising the footrest, so as to compensate for the progressive moving away of the hinging points of the kinematic connecting rod-crank transmission mechanism between the driving shaft and the footrest.

Further motor-driven transmission mechanisms are disclosed by U.S. Pat. No. 3,934,929, wherein a worm screw actuator is connected on one end to the seat of the chair and on the other end to the backrest, and by DE-U-89 04 979, wherein the movement of chair portions is obtained thanks to a motor unit extending between a fixed frame and the backrest.

It is a general object of the present invention to eliminate the above mentioned drawbacks by providing an armchair with power-driven footrest and back, which has an innovatory kinematic movement structure with a dual motor. In view of the above object, in accordance with the invention, an armchair has been devised which comprises a support frame to which a base seat, a back and a footrest are fastened, which elements are movable between a first and a second positions through power-driven movement means, characterized in that the power-driven means is suspended from said base seat and movable therewith.

An armchair structure has also been conceived, in which the base seat is pivotally mounted at the front on the support frame according to a first transverse axis, on said base seat being pivotally mounted the back, at the rear thereof, according to a second transverse axis for rotation of the back, the back having extensions extending downwardly past said second axis and having ends constrained to slide longitudinally of the armchair, so that on rotation of the back about said second axis, the base seat rotates in the same way about said first axis.

BRIEF DESCRIPTION OF THE DRAWINGS

For better explaining the innovatory principles of the present invention and the advantages it offers over the known art, a possible embodiment of the invention applying these principles will be described hereinafter, with the aid of the accompanying drawings. In the drawings.

Figure 1:
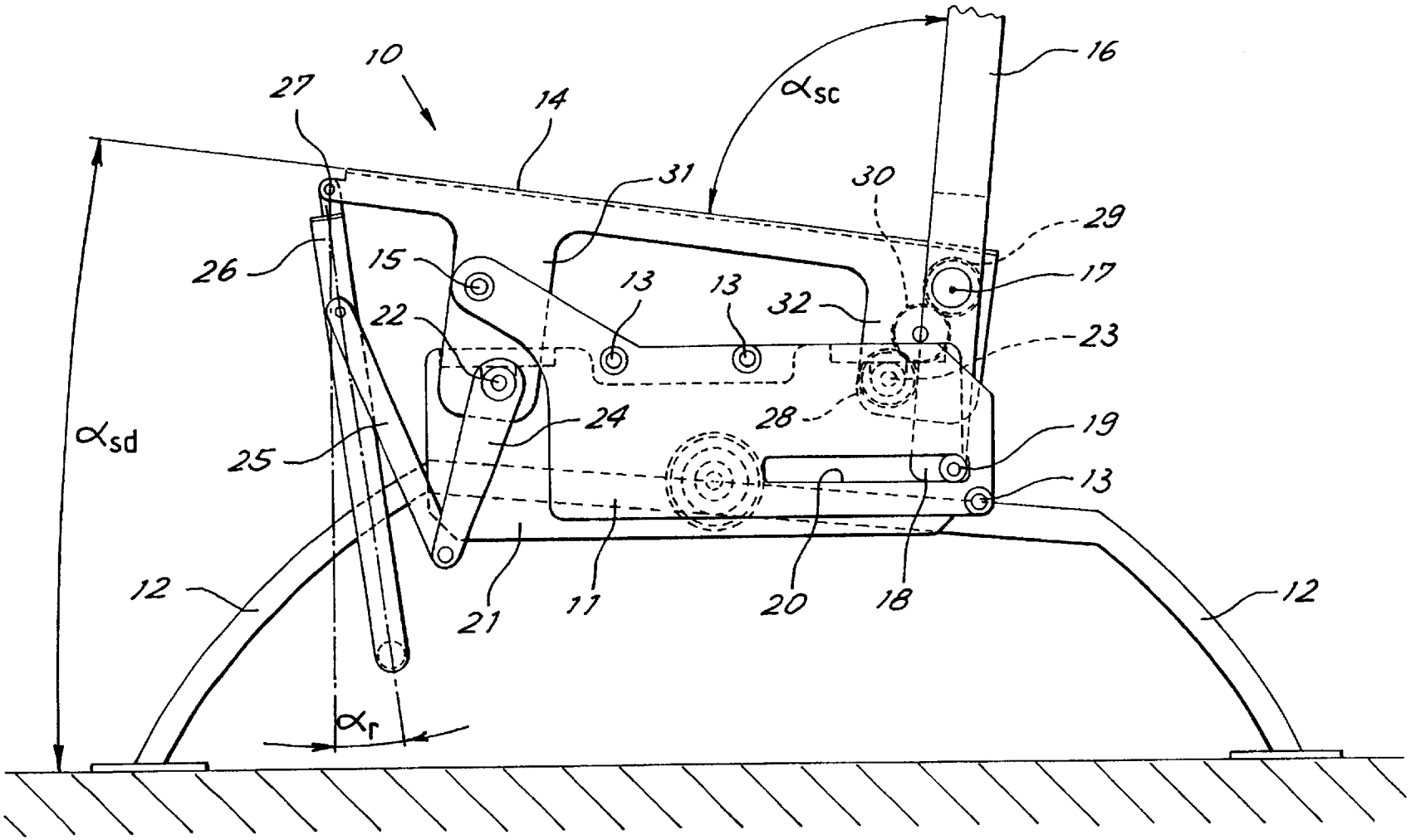
FIG. 1 is a diagrammatic and fragmentary elevation side view of an armchair in accordance with the invention, with footrest and back in a first position.

With reference to the drawings, an armchair is shown which is generally denoted by 10 and made in accordance with the invention.

DETAILED DESCRIPTION OF THE INVENTION

Shown in the figures is only one side of the armchair, the other side substantially being a mirror image of the first one.

The armchair 10 comprises a base frame, essentially formed of a pair of side shoulders 11 and pairs of front and rear legs 12. The side shoulders (only one of which is shown) are interconnected by crosspieces 13 for frame stiffening.

A base seat 14 is pivotally mounted at the front to the side shoulders 11 according to a transverse axis 15. At the rear, the base seat is pivotally mounted to a back 16 according to a transverse axis 17.

A footrest 26 is pivotally mounted to the base seat according to an axis 27. The back has extensions 18 extending downwardly past axis 17 for coupling with the frame in a horizontally slidable manner. According to a preferred embodiment, coupling is obtained by pins or runners 19 laterally projecting from the extension for insertion into horizontal slits 20 present in the side shoulders.

The movement unit of the armchair is embodied by a substantially known dual motor 21, hanging from the base seat for moving therewith.

Advantageously, the motor is suspended from the base seat at its two power-driven shafts 22, 23. For the purpose, the base seat has pairs of front and rear lateral sides 31, 32.

The front shaft 22 is connected to the footrest by a connecting rod-crank connection 24, 25, whereas the rear shaft 23 is connected to the rotation axis 17 of the back by a transmission gear formed of a pair of gears 28, 29 (integral with the driving shaft and the back, respectively) between which a third gear 30 is present which is supported in a freely rotatable manner on the base seat side. The rotation axis 15 of the base seat is placed between the base seat surface and the front driving shaft 22.

Shown in FIG. 1 is the armchair with its back in the vertical position and its footrest completely lowered. In such a position between the back and the base seat there is a first angle $\alpha_{sc}$, of 87° for example, and between the base seat and the horizontal surface there is a first angle $\alpha_{sd}$, of 8° for example.

The footrest can be advantageously moved backward towards the inside of the armchair by an angle $\alpha_r$ of 3.5° for example, relative to the vertical.

Figure 2:
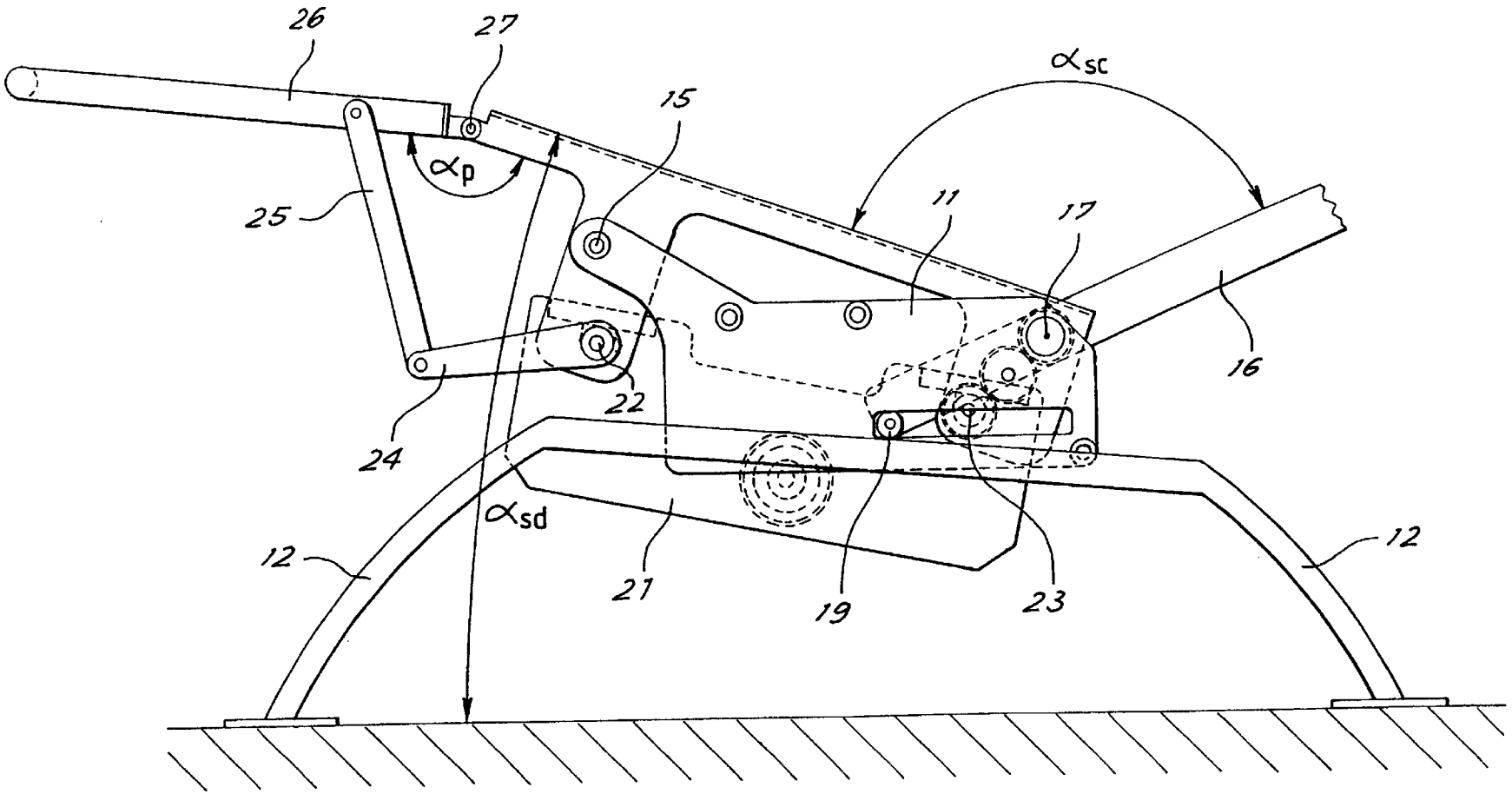
FIG. 2 represents a view similar to that in FIG. 1, but with footrest and back in a second position.

As viewed from FIG. 2, by operating the power-driven rear shaft 23, the back rotates downwardly about axis 17. The corresponding sliding of the lower runner 19 and consequent lowering of axis 17, cause a simultaneous rotation of the base seat in the same way as the back, but about axis 15. When the back is completely lowered, angle $\alpha_{sc}$ between the back and the base seat is equal to 137° for example, the base seat having an angle $\alpha_{sd}$ going from 8° to 19.5°, for example.

As still shown in FIG. 2, by operating the front driving shaft 22 the footrest 26 can be raised in an independent manner for decreasing angle $\alpha_p$ between the footrest itself and the base seat, until a position of maximum lifting is reached in which angle $\alpha_p$ is of 166.5°, for example. When the back is completely lowered, there is therefore an angle of 6° for example, between the base seat and the horizontal surface.

At this point it is apparent that the intended purposes have been achieved.

Movement of the motor with the base seat enables a smaller angle of rotation of the driving shaft to be required for completely lifting the footrest, as compared with the case of the motor fixed to the frame. In addition, due to the movement of the base seat being linked to the back rotation, the kinematic mechanisms are simplified and the footrest movement is made independent, and in addition there is always an appropriate angle between the base seat and the back even without moving the footrest. Since the base seat tilts on inclination of the back, the armchair is made much more comfortable and too much stress at the lumbar region is avoided.

Obviously, the above description of an embodiment applying the innovatory principles of the present invention is for purposes of illustration only and therefore must not be considered as a limitation of the scope of the invention as herein claimed.

For example, the armchair structure can be upholstered as preferred. Proportions of the parts and movement limits too can be varied depending on specific requirements.

What is claimed is:

1. An armchair, comprising:

a) a support frame;

b) a base seat, a back and a footrest fastened to said support frame;

c) a power unit suspended from said base seat and movable therewith, said power unit being operably connected to said base seat, said back and said footrest to move said base seat, said back and said footrest between respective first and second positions;

d) said power unit including independent front and rear driving shafts;

e) said front driving shaft being connected to said footrest in a kinematic manner to control movement thereof; and f) said rear driving shaft being connected to said back and said base seat in a kinematic manner to control simultaneous movement of said back and said base seat independently of the movement of said footrest.

2. An armchair as in claim 1, wherein:

a) said front driving shaft being disposed close to said footrest; and b) said rear driving shaft being disposed close to said back.

3. An armchair as in claim 1, wherein:

a) said power unit has a generally elongated shape, including front and rear portions; and b) said front and rear driving shafts are disposed close to said front and rear portions, respectively.

4. An armchair as in claim 1, wherein:

a) said base seat at its front is pivotally mounted to said support frame at a first transverse axis;

b) said base seat at its rear is pivotally mounted to said back at a second transverse axis; and c) said back includes an extension extending past said second transverse axis, said extension having ends constrained to slide longitudinally of said armchair so that on rotation of said back about said second transverse axis, said base seat rotates about said first transverse axis.

5. An armchair as in claim 1, wherein:

a) said ends include runners constrained to slide along horizontal slits formed in said support frame.

6. An armchair as in claim 1, wherein:

a) a first gear fitted to said rear driving shaft;

b) a second gear fitted about said second transverse axis; and c) a transmission gear is disposed between said first and second gears.

7. An armchair as in claim 1, wherein:

a) a kinematic connecting rod-crank mechanism for movement of said footrest is disposed between said front driving shaft and said footrest.

8. An armchair as in claim 1, wherein:

a) said power unit is suspended from said base seat at said front and rear driving shafts.

9. An armchair as in claim 1, wherein:

a) said first transverse axis is disposed between a top surface of said base seat and said front driving shaft.

* * * * *